US007446787B2

(12) United States Patent
Kishi

(10) Patent No.: US 7,446,787 B2
(45) Date of Patent: Nov. 4, 2008

(54) IMAGE FORMING APPARATUS IN WHICH A FAN IS USED TO AFFECT AIR FLOW

(75) Inventor: Takehiro Kishi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 120 days.

(21) Appl. No.: 11/452,344

(22) Filed: Jun. 14, 2006

(65) Prior Publication Data

US 2006/0284960 A1 Dec. 21, 2006

(30) Foreign Application Priority Data

Jun. 15, 2005 (JP) ..... 2005-175707

(51) Int. Cl.
*B41J 2/385* (2006.01)
*B41J 2/435* (2006.01)
*G03G 9/08* (2006.01)
*G03G 21/20* (2006.01)

(52) U.S. Cl. ..... 347/156; 347/263; 399/92

(58) Field of Classification Search ..... 347/155–156, 347/170, 263; 399/9, 39, 70, 91–93, 122, 399/320; 250/214 R
See application file for complete search history.

(56) References Cited

U.S. PATENT DOCUMENTS 4,540,268 A * 9/1985 Toyono et al. ..... 399/93
4,693,588 A * 9/1987 Yarbrough et al. ..... 399/93
4,891,678 A * 1/1990 Ishizu et al. ..... 399/91
4,947,033 A * 8/1990 Kordts et al. ..... 250/214 R
5,164,778 A * 11/1992 Tanabe et al. ..... 399/9
5,210,576 A * 5/1993 Haneda et al. ..... 399/39
5,307,132 A * 4/1994 Tsuchiya ..... 399/70
5,390,006 A * 2/1995 Wakabayashi et al. ..... 399/92
5,579,098 A * 11/1996 Noguchi et al. ..... 399/122
6,141,512 A * 10/2000 Nagano et al. ..... 399/92
6,266,498 B1 * 7/2001 Oda et al. ..... 399/92
2006/0039716 A1 * 2/2006 Sahara ..... 399/92

FOREIGN PATENT DOCUMENTS

JP 6-258970 9/1994
JP 2001-183959 7/2001
JP 2003-280414 10/2003

* cited by examiner

*Primary Examiner*—Hai C Pham
(74) *Attorney, Agent, or Firm*—Fitzpatrick, Cella, Harper & Scinto

(57) ABSTRACT

An image forming apparatus includes an image forming unit for forming a toner image on a recording material. A first accommodating body accommodates the image forming unit. A fixing unit fixes an image formed by the image forming unit on the recording material. A second accommodating body accommodates the fixing unit, with the second accommodating body being attached to an external part of the first accommodating body. An air current path is formed by a space created by connecting the first accommodating body and the second accommodating body such that the recording material on which the image has been formed is conveyed from the first accommo-dating body to the second accommodating body in order to fix the image. The air current path is adapted to guide air to move outside of the apparatus by use of fans.

6 Claims, 8 Drawing Sheets

IMAGE FORMING APPARATUS IN WHICH A FAN IS USED TO AFFECT AIR FLOW

BACKGROUND OF THE INVENTION

1. Field of the Invention

The present invention relates to image forming apparatuses such as copying machines, facsimile machines, and printers.

2. Description of the Related Art

Generally, an image forming apparatus using an electro photographic process includes an image forming station in which a latent image formed using light, magnetism, electric charges, or the like is rendered visible and thereby a visible image is obtained. The visible image is transferred to a recording sheet fed to the image forming station. FIG. 7 shows an example of the color image forming apparatus, which is structured such that four image forming stations Pa, Pb, Pc, and Pd include photosensitive drums 1*a*, 1*b*, 1*c*, and 1*d*, respectively serving as image bearing members. Disposed around the photosensitive drums 1*a*, 1*b*, 1*c*, and 1*d* in the direction of the drum rotation are: exposure portions 2*a*, 2*b*, 2*c*, and 2*d;* developing portions 3*a*, 3*b*, 3*c*, and 3*d;* primary transfer portions 4*a*, 4*b*, 4*c*, and 4*d*, each of which includes a drum and roller in combination; and cleaning portions 5*a*, 5*b*, 5*c*, and 5*d*. Below the photosensitive drums 1*a* to 1*d*, an intermediate transfer belt 6 is stretched round a series of rollers in an endless flat belt. A roller 7, which is one of the rollers, is used as a drive motor, to which rotating power is input from a drive source motor (not shown). Disposed around the intermediate transfer belt 6 in the running direction of the belt, as shown by the arrow in the drawing, are a registration detection sensor 8, a secondary transfer portion including a pair of rollers 9 and 11, an intermediate transfer cleaning portion 10, and the like.

With this configuration, a color image is formed as follows. First, in the exposure portion 2*a* of the first image forming station Pa, a latent image for a yellow (Y) component color of the image of an original is formed on the photosensitive drum 1*a* by an electrophotographic means. Subsequently, in the developing portion 3*a*, the latent image is rendered visible by developer that has Y color toner. In the primary transfer portion 4*a*, the Y color toner image formed by rendering the latent image visible is transferred onto the intermediate transfer belt 6. In the course of transfer of the Y color toner image to the intermediate transfer belt 6, in the second image forming station Pb, a latent image for a magenta (M) component color is formed on the photosensitive drum 1*b* in the same manner and, subsequently, a magenta toner image is formed with M color toner in the developing portion 3*b*. When the intermediate transfer belt 6 to which the Y color toner image is transferred in the first image forming station Pa reaches the primary transfer portion 4*b* in the second image forming station Pb, an M color toner image is transferred to the predetermined part on the intermediate transfer belt 6 to which the Y color toner image has been transferred.

An image for a cyan (C) color and an image for a black (Bk) color are also formed in the same manner. After the four toner images of the four different colors are superposed one on another on the intermediate transfer belt 6, the intermediate transfer belt 6 is further moved so that the toner images reach the secondary transfer portion 9, 11, where the toner images are transferred all at once onto a sheet fed to the secondary transfer portion. The sheet on which the toner images formed by the above-described image forming means have been transferred all at once is fed to a conveying mechanism 20. In the conveying mechanism 20, the sheet is placed onto a conveying belt, through which a large number of suction holes are made; and the sheet is fed to a fixing device 13 while sheet is drawn and held on the belt by a suction fan. In the fixing device 13, the toner images are fixed onto the sheet under pressure and heat applied by a fixing roller pair and an internal heater. After such a fixing process, the sheet is ejected from the main body of the apparatus.

In the field of the color image forming apparatuses, such as that shown in FIG. 7, demands for higher image quality and higher speed image output have been growing exponentially recently.

In order to produce an image having a high image quality at a high speed, it is necessary to enhance the capability of fixing toner to a recording sheet. A structure in which two or more fixing units is disposed on a sheet conveyance path and the sheet is passed through fixing nips in sequence to improve fixing performance is required (Japanese Patent Application Laid-Open No. 6-258970). It may be necessary that the size of a fixing unit be increased to enhance fixing capability.

Such an increase in the size of a fixing means in order to improve the fixing capability may greatly affect transport of an image forming apparatus structured such that the image forming means and the fixing means are accommodated in one accommodating body. For example, the image forming apparatus cannot be carried into an elevator. In view of such a case, a structure has been proposed that allows the separation of an image forming device including image forming stations and the like, and a fixing device including a fixing unit and the like (Japanese Patent Laid-open No. 2001-183959).

Even in such a configuration, heat is conducted from the fixing unit accommodating body to the image forming accommodating body. In order to prevent such heat conductor, the configuration in which an air duct is provided between the fixing unit and the image forming unit is conventionally known (JP-A No. 2003-280414).

However, in the case where the fixing accommodating body and the image forming accommodating body are separated from each other, the provision of such an air duct in either the fixing accommodating body or image forming accommodating body leads to another problem, that is an increase in the number of components.

SUMMARY OF THE INVENTION

It is, accordingly, an object of the present invention to provide an image forming apparatus designed such that the image forming device and the fixing device can be separated for the convenience of transfer or installation of the image forming apparatus and the separating structure is also utilized to prevent heat or the like generated in the fixing device during the operation of the apparatus from affecting the image forming device.

The above and other objects of the present invention will be clarified by a first aspect and the following explanations.

DESCRIPTION OF THE EMBODIMENTS

Figure 7:
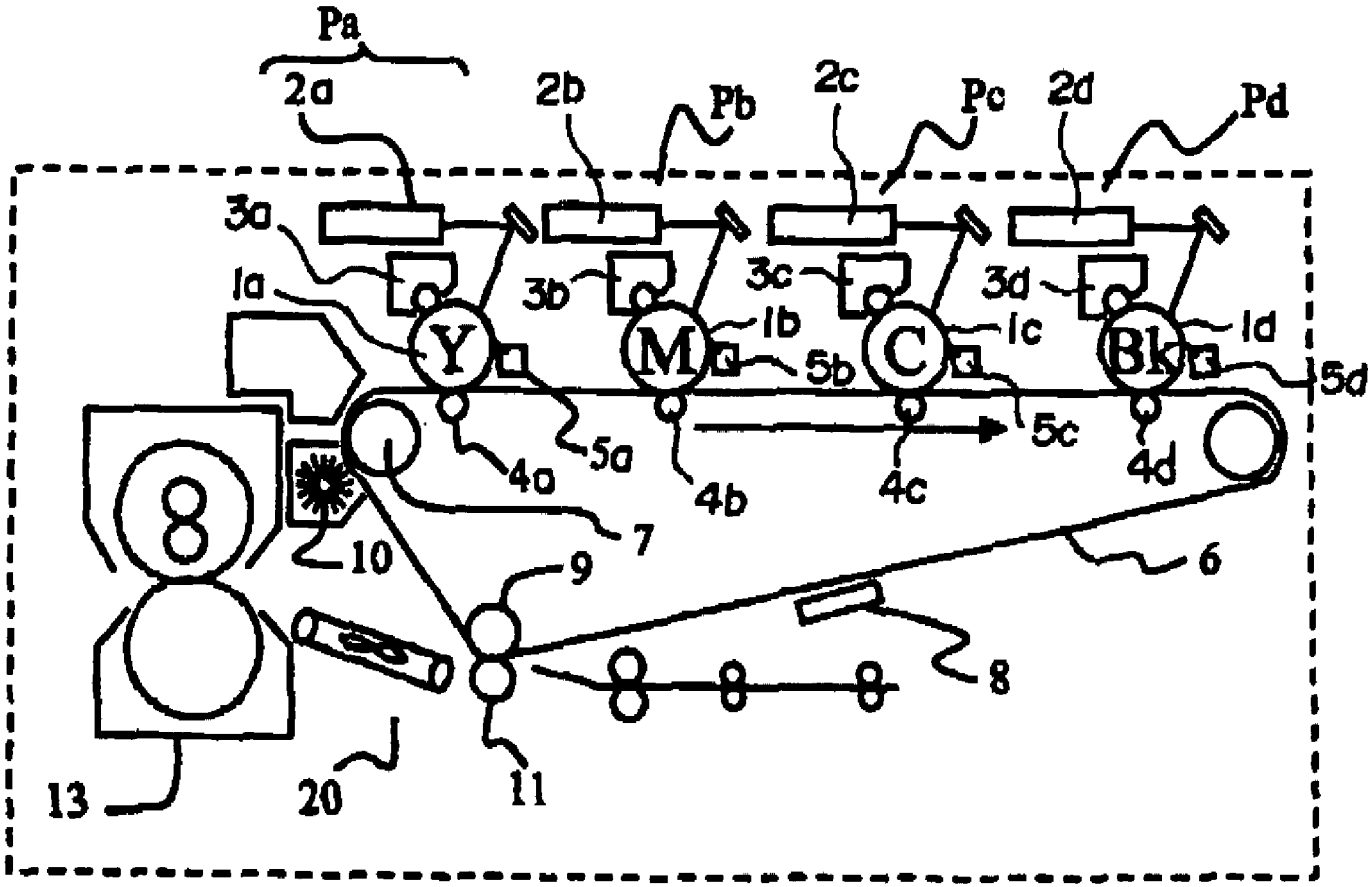
FIG. 7 is a view showing a conventional image forming apparatus.

Referring to the accompanying drawings, a preferred embodiment of an image forming apparatus according to the present invention will now be described in detail. Reference numerals identical to those of a conventional image forming apparatus shown in FIG. 7 are denoted, and explanations of these are not described. Only descriptions of features that are distinctively different from those in a conventional image forming apparatus will be given.

Figure 1:
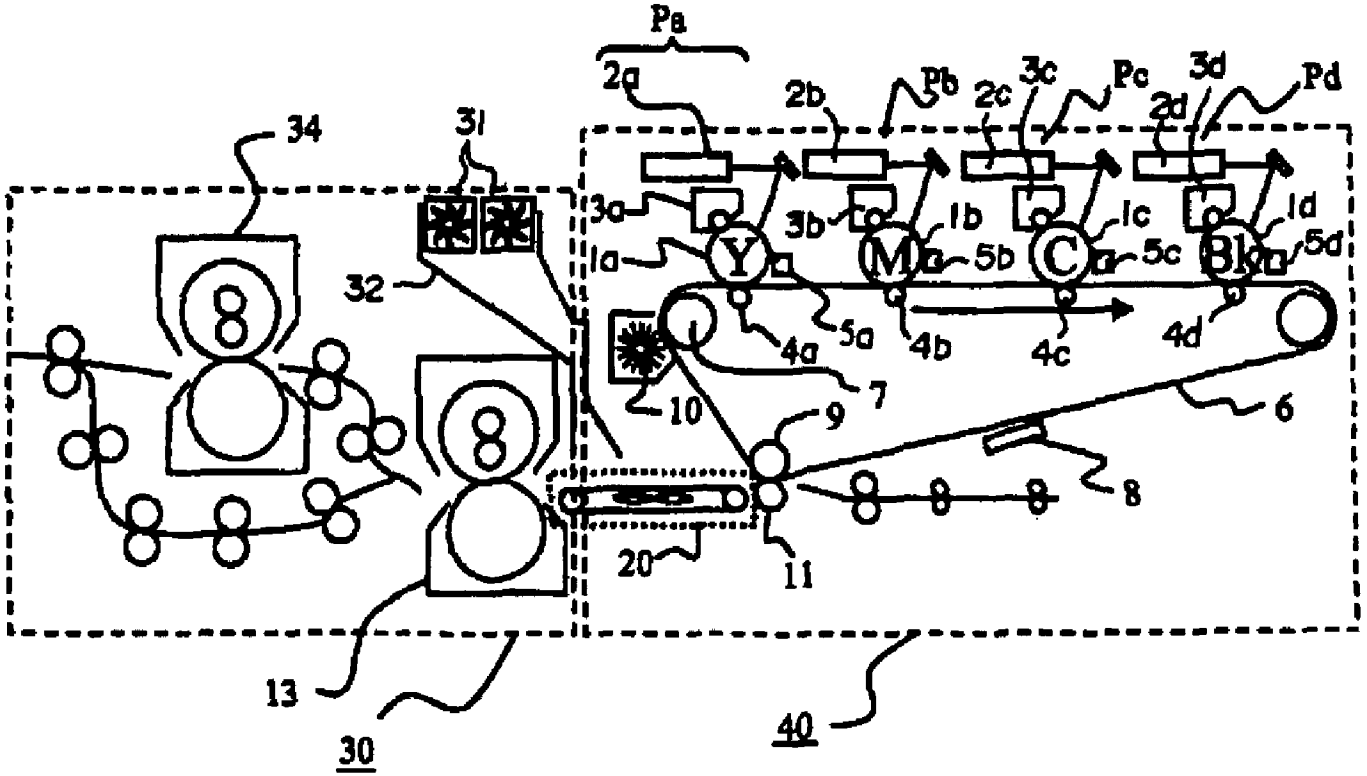
FIG. 1 is a view showing the entire structure of an image forming apparatus according to the present invention.

As shown in FIG. 1, a color electrophotographic copying machine according to the present invention has the four image forming stations Pa, Pb, Pc, and Pd. The image forming stations Pa, Pb, Pc, and Pd include the photosensitive drums 1*a*, 1*b*, 1*c*, and 1*d* respectively as image bearing members. Disposed around the photosensitive drums 1*a*, 1*b*, 1*c*, and 1*d* in the direction of rotation are: the exposure portions 2*a*, 2*b*, 2*c*, and 2*d*, which are image exposure means for exposing images onto the corresponding photosensitive drums electrified by charging means; the developing portions 3*a*, 3*b*, 3*c*, and 3*d*, which are developing means for developing electrostatic latent images onto the corresponding photosensitive drums; the primary transfer portions 4*a*, 4*b*, 4*c*, and 4*d* for transferring the toner images on the corresponding photosensitive drums to an intermediate transfer member; and the cleaning portions 5*a*, 5*b*, 5*c*, and 5*d*. Below the photosensitive drums 1*a* to 1*d*, the intermediate transfer belt 6 is stretched round the series of rollers in an endless flat belt. The roller 7, which is one of the rollers, is used as the drive motor, to which rotating power is input from the drive source motor (not shown). Disposed around the intermediate transfer belt 6 in the running direction of the belt, as shown by the arrow in the drawing, are the registration detection sensor 8, the secondary transfer portion comprising the pair of rollers 9 and 11, the intermediate transfer cleaning portion 10 or the like.

Specifically, in the exposure portion 2*a* of the first image forming stations Pa, a latent image for a yellow (Y) component color of the image of an original is formed on the photosensitive drum 1*a* by the electrophotographic means. Subsequently, in the developing portion 3*a*, the latent image is rendered visible by developer that has Y color toner. On the intermediate transfer belt 6 driven and run by the drive roller 7 or the like, the Y color toner image obtained by rendering the latent image visible is transferred to the surface of the belt in the primary transfer portion 4*a*. In the course of primary transfer of the Y color toner image to the intermediate transfer belt 6, in the second image forming station Pb, a latent image for a magenta (M) component color is formed on the photosensitive drum 1*b* in the same manner and, subsequently, a magenta toner image is formed with M color toner in the developing portion 3*b*. When the Y color toner image transferred to the intermediate transfer belt 6 to which Y color toner image is transferred in the first image forming station Pa reaches the primary transfer portion 4*b* of the second image forming station Pb, an M color toner image is transferred to the predetermined part on the intermediate transfer belt 6 to which the Y color toner image has been transferred. An image for a cyan (C) color and an image for a black (Bk) color are also formed in the same manner. After the four toner images of the four different colors are superposed one on another on the intermediate transfer belt 6, the intermediate transfer belt 6 is further moved so that the toner images are transferred all at once onto a sheet, which is a recording material, in the secondary transfer portion 9.

Figure 4:
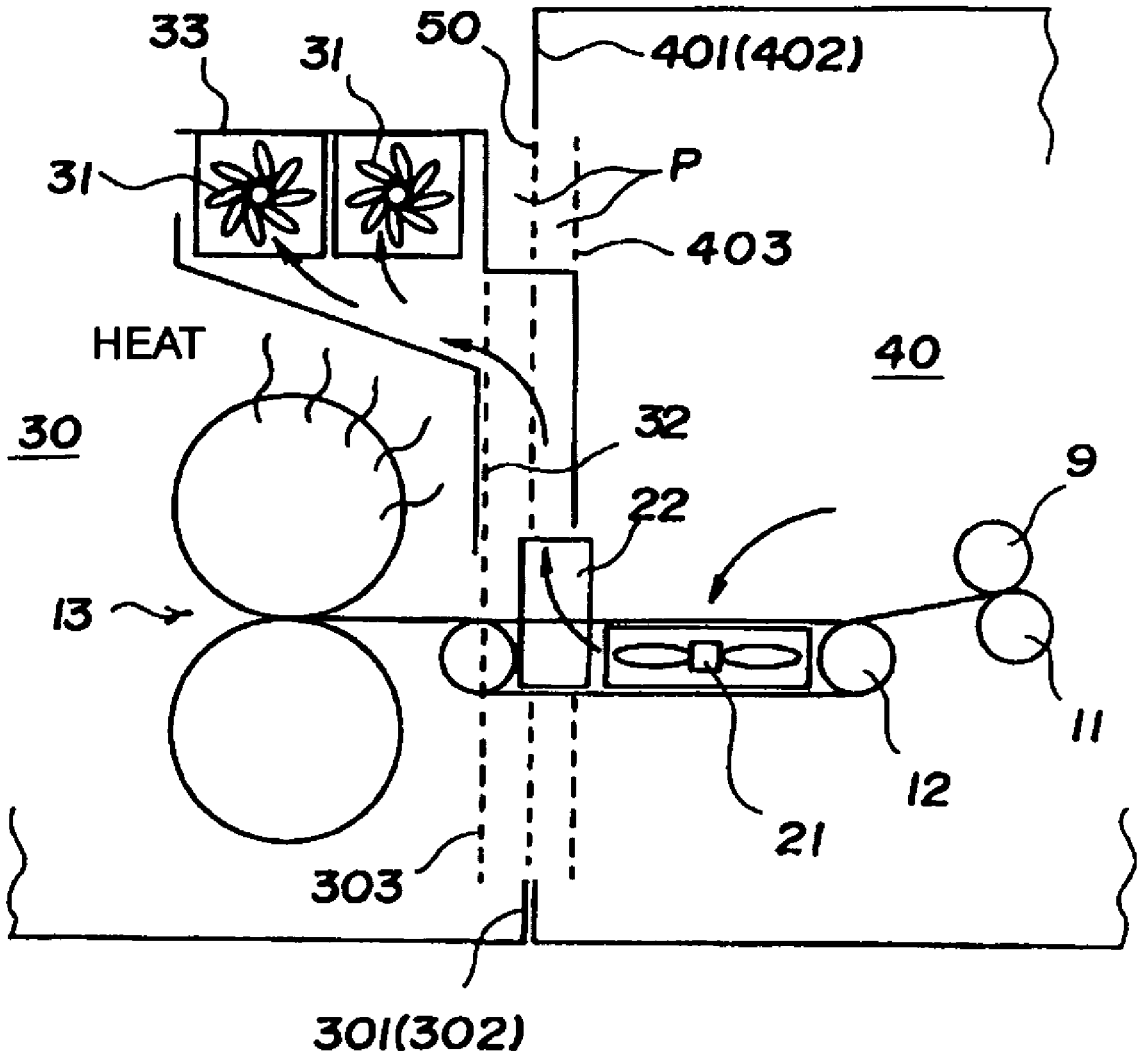
FIG. 4 is a sectional view showing an exhaust duct portion according to the present embodiment.

As shown in FIGS. 1 and 4, the sheet on which the toner images on the intermediate transfer belt 6 have been transferred all at once in the secondary transfer portion 9 is fed to the conveying mechanism 20. In the conveying mechanism 20, the sheet is placed onto a conveying belt 12, through which a large number of suction holes have been made; and the sheet is conveyed to a fixing device 13, which is located downstream side of it, while held on the belt by suction using an electric suction fan (suction means) 21. The toner images are fixed onto the sheet by the fixing device 13 that comprises the roller pair. Thus, a full-color image is formed.

In this case, the image forming device including the above-described image forming stations Pa to Pd and so on is accommodated in an image forming device frame body 40, which is a first accommodating body. The fixing device 13 serving as an image heating means, a second fixing device 34 (described later), and so on are accommodated in a fixing device frame body 30, which is a second accommodating body and is separated from the image forming section frame body 40. Each of the frame bodies 30 and 40 is an casing formed from rectangular pipes P, which forms a framework, thin steel plates, which are to be side plates, and so on. To position and set the fixing device frame body 30, they are set up together with pins disposed on the external parts of the image forming device frame body 40, which serve as mounting references. The image forming device frame body 40 and the fixing device frame body 30 are movable independently of each other.

Outputting an image of high image quality can be accomplished by passing a sheet through the nip of the second fixing device 34 accommodated in the fixing device frame body 30, thereby improving fixing performance of a toner to the sheet. The sheet subjected to the fixing process in the second fixing device 34 is fed to a sheet ejecting portion and ejected from the image forming apparatus.

Additionally, disposed in the upper part of the fixing device frame body 30 are exhaust means 31, which are axial electric fans. An exhaust duct portion is extended as far as the exhaust fans and defined by the side plates 32 and the frame body top plate 33 of the fixing device frame body. The exhaust duct portion conveys heat generated by the fixing devices 13 and 34 out of the main body of the apparatus. The exhaust duct portion also sucks up and exhausts fine toner particles in the air drawn from the image forming device frame body 40. Therefore, a dustproof filter for removing such fine toner particles or dust is preferably disposed in the exhaust duct portion at upstream side of the exhaust fans 31.

Figure 2A:
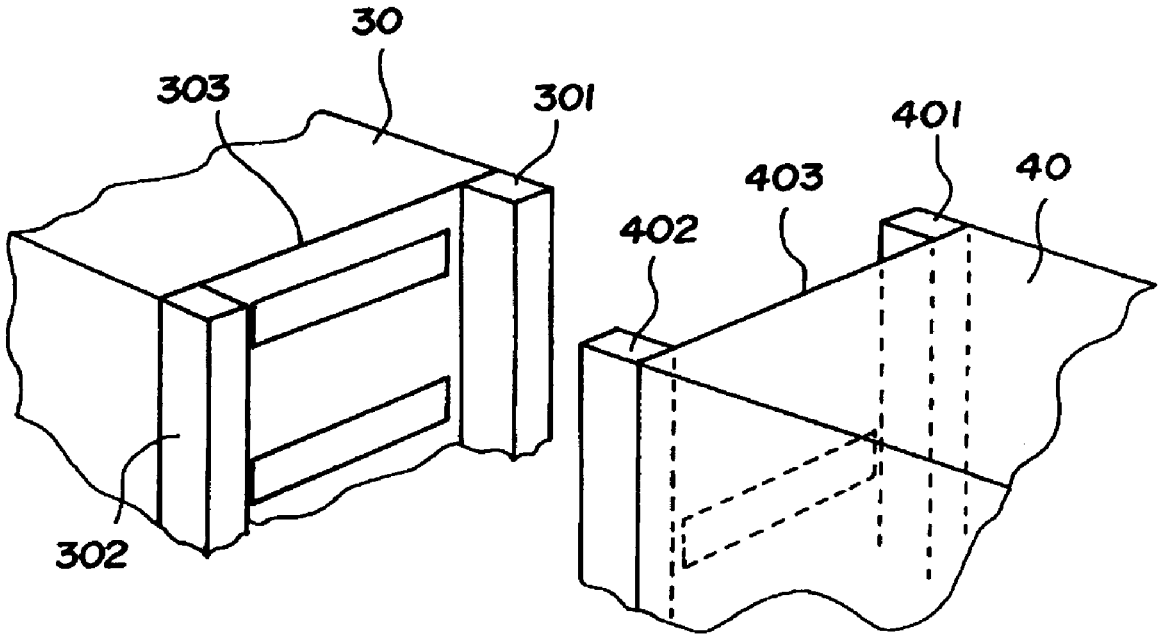
FIGS. 2A and 2B are perspective views showing a fixing device frame body and an image forming device frame body before and after they are connected to each other.
Figure 2B:
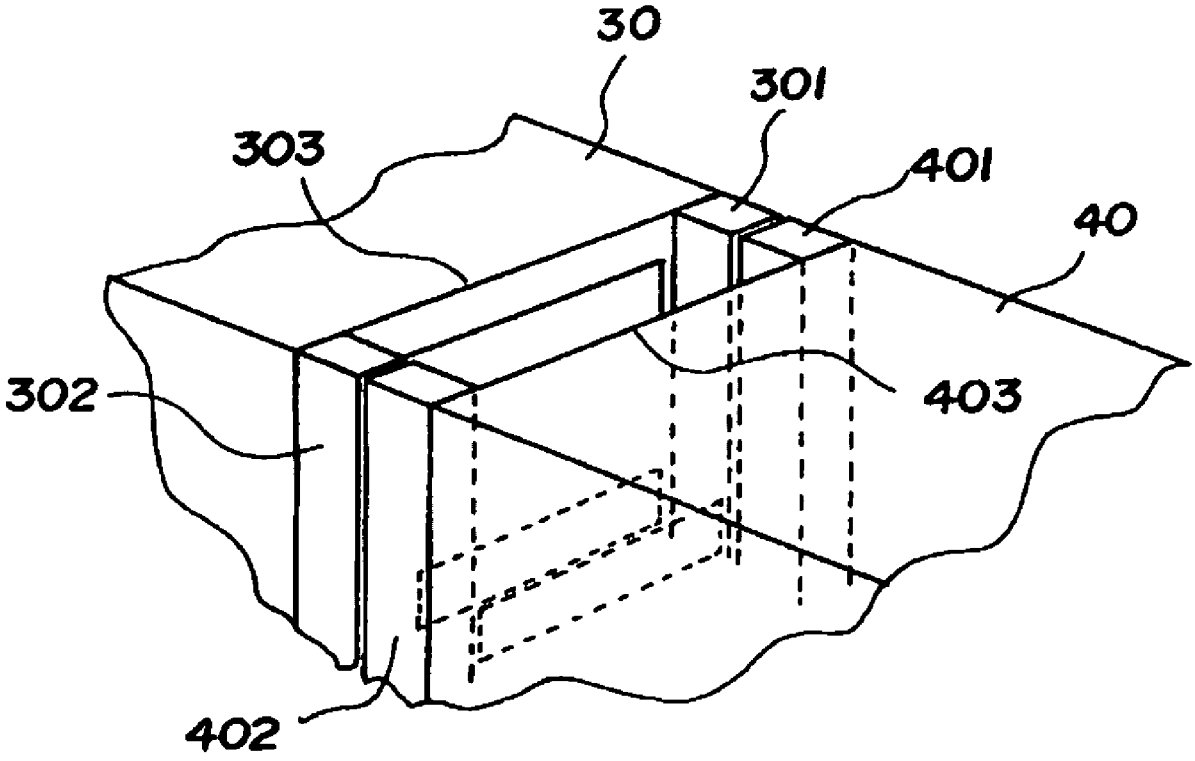

An explanation will now be given referring to FIG. 2. FIG. 2 show the heads of the external parts of the fixing device frame body 30 and image forming device frame body 40. FIG. 2A is a view showing the fixing device frame body 30 and the image forming device frame body 40 before they are connected to each other, and FIG. 2B is a view showing the fixing device frame body 30 and the image forming device frame body 40 after they are connected to each other. Reference numerals 401 and 402 denote the first air current path forming member. In the present embodiment, pipes are used as the first air current path forming member, and project from the side plate 403 of the image forming device frame body 40. Also, reference numerals 301 and 302 denote a second air current path forming member. In the present embodiment, pipes are used as the second air current path forming member, and project from the side plate 303 of the fixing device frame body 30. When the fixing device frame body 30 and the image forming device frame body 40 are connected, as shown in FIG. 2B, a space is defined between the side plates 303 and the side plate 403. This space serves as an air current path according to the present invention.

Figure 3:
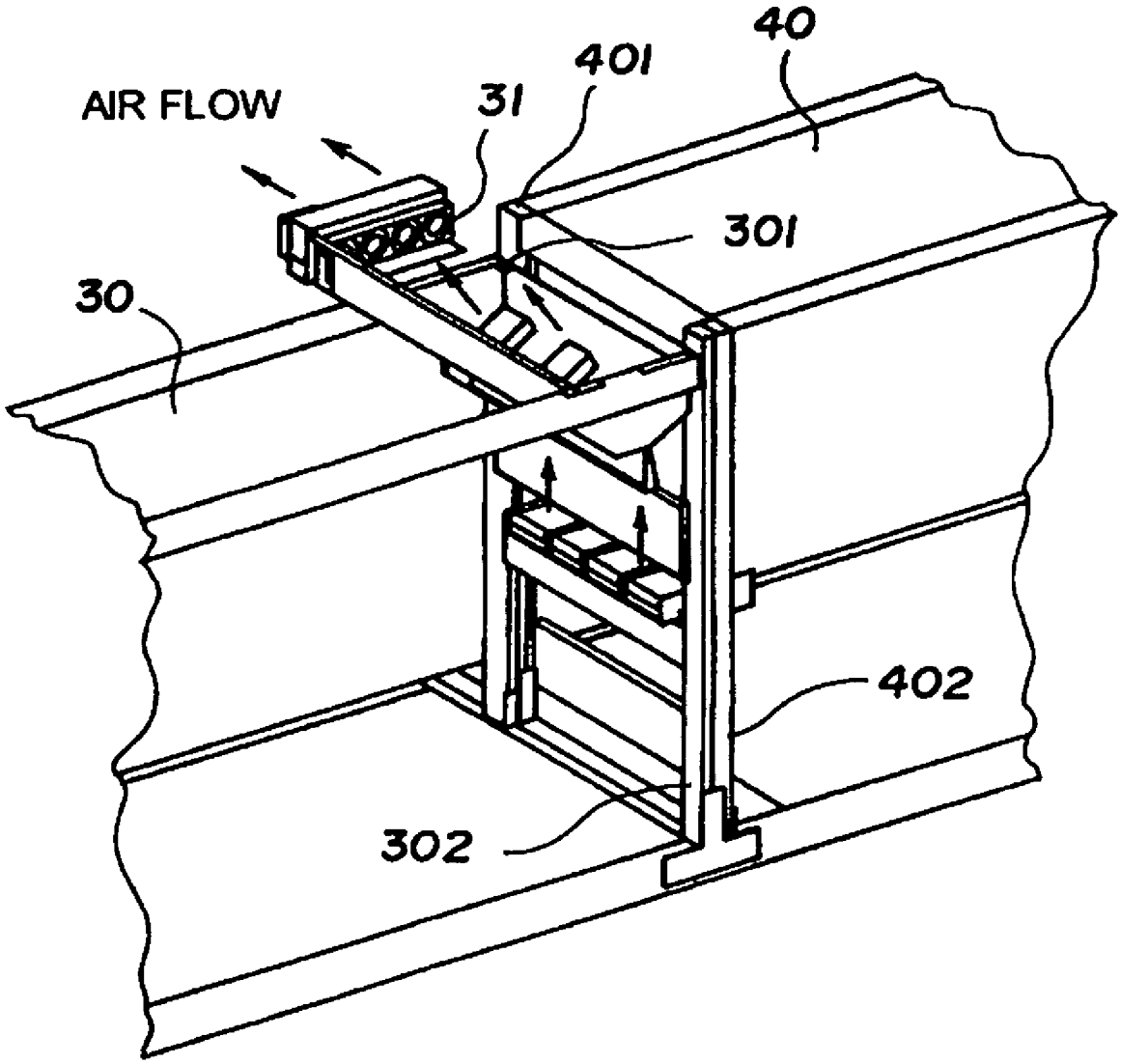
FIG. 3 is a perspective view showing the fixing device frame body and image forming device frame body after they are connected to each other.

FIG. 3 shows a flow of air current created using the air current path. Air in the air current path is drawn and exhausted by the fan disposed in the fixing device frame body 30.

As described above, leaving a suitable amount of space between the side plates (i.e., connecting parts), which join together the fixing device frame body 30 and image forming device frame body 40, defines the air current path (i.e., duct space) through which an air current flows. Joining the space duct between the side plates and the exhaust duct extending to the above-described exhaust fans 31 allows the space duct and the exhaust duct to communicate with each other, thus composing an 'exhaust duct portion' via which the image forming device frame body 40 communicates with the fixing device frame body 30. Therefore, the exhaust duct portion is formed for the first time when the image forming device frame body 40 and the fixing device frame body 30 are connected together so that the side plates of both the frame bodies are joined together. Specifically, according to the present embodiment, the positions of the side plates on the side where the fixing device frame body and the image forming device frame body face each other are further pitted compared to the portions where the fixing device frame body and the image forming device frame body are connected together.

Referring to FIG. 4, an explanation will now be given. FIG. 4 shows the image forming apparatus as viewed from the front. Reference numerals 401 and (402) denote the ends of the front and rear side plates of the image forming device frame body, and reference numbers 301 and (302) denote the ends of the front and rear side plates of the fixing device frame body. Reference numeral 50 denotes a connecting portion for the front side plate and rear side plate. The image forming portion frame body and the fixing device frame body are connected such that the positions of the opposite faces, namely the side plates 403 and 303, are set at the opposite side to each of the facing direction compared to the connecting portion. Thus, a space serving as a path for an air current is defined. In the present embodiment, the positions of the side plates of both the frame bodies forming the air current path are set at the opposite side to each of the facing direction compared to the connecting portion. However, a space for the air current path can be formed to the extent that either one of the frame bodies has the structure described above.

If a slight gap remains in the connecting portion between the image forming device frame body 40 and the fixing device frame body 30 when these are joined together to form the exhaust duct portion, the seal weakens, which may lead to degradation in the sucking function of each of the exhaust fans 31. In order to prevent this, in the connecting portion, a sealing member made of an elastic foam material is disposed between the frame bodies. This enhances the sealing performance and effectively exhausts heat generated. In order that hot air generated in the fixing device frame body 30 and flowing upward is more effectively exhausted from the main body of the apparatus, the exhaust fans 31 are attached to the top plate 33 of the fixing device frame body 30, as in the present embodiment, rather than to that of the image forming device frame body 40.

Figure 5:
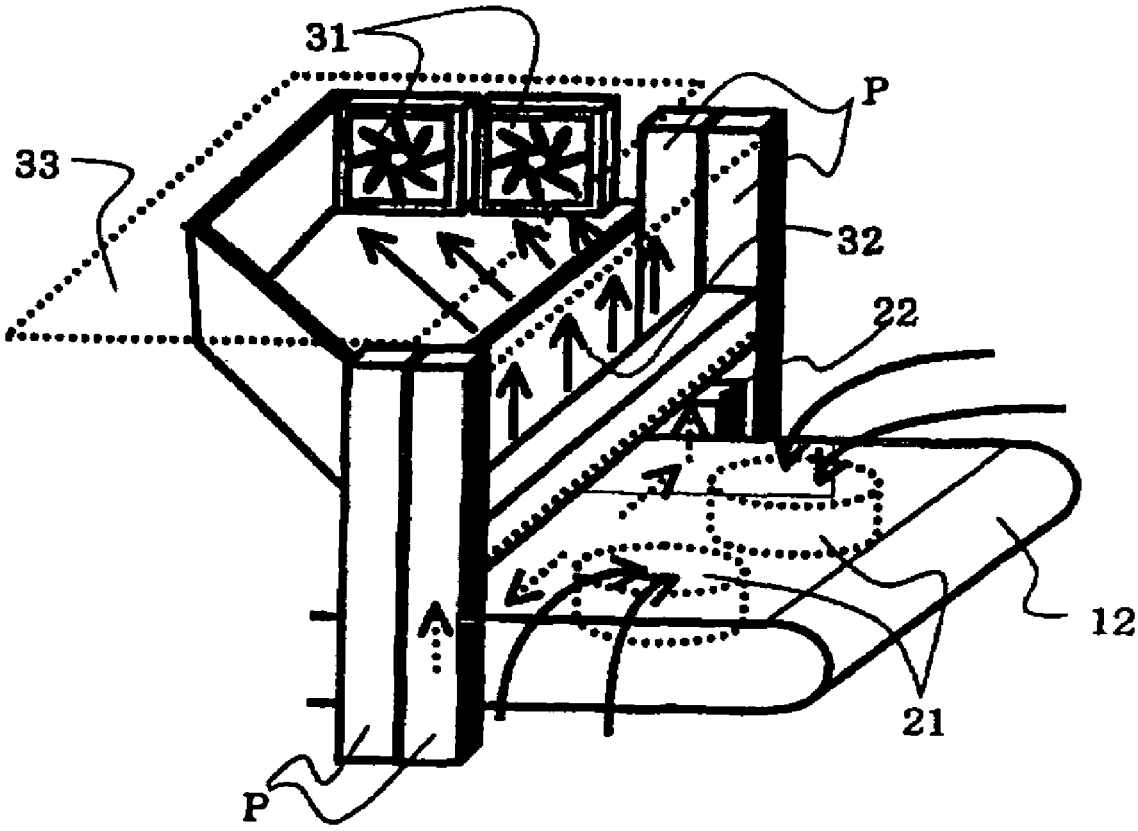
FIG. 5 is a perspective view showing the exhaust duct portion according to the present embodiment.

As is apparent in FIGS. 4 and 5, the conveying mechanism 20 is disposed in the image forming device frame body 40 and downstream of the secondary transfer part that comprises the pair of rollers 9 and 11 in the biting manner. The end of the conveying belt 12 extends as far as the fixing device frame body 30. As the suction means 21 for the conveying mechanism 20, for example, two Sirocco fans are used. On the Sirocco fan exhaust side, a fan duct (cooling air supply duct) 22 is provided extending upward (i.e., in a direction vertical to the direction in which a sheet is conveyed, in the drawing). The exhaust port on the outlet side of the fan duct 22 is located outside the region where the sheet is conveyed. The direction of the exhaust port is set such that the exhaust port communicates with the above-described exhaust duct portion.

Figure 6:
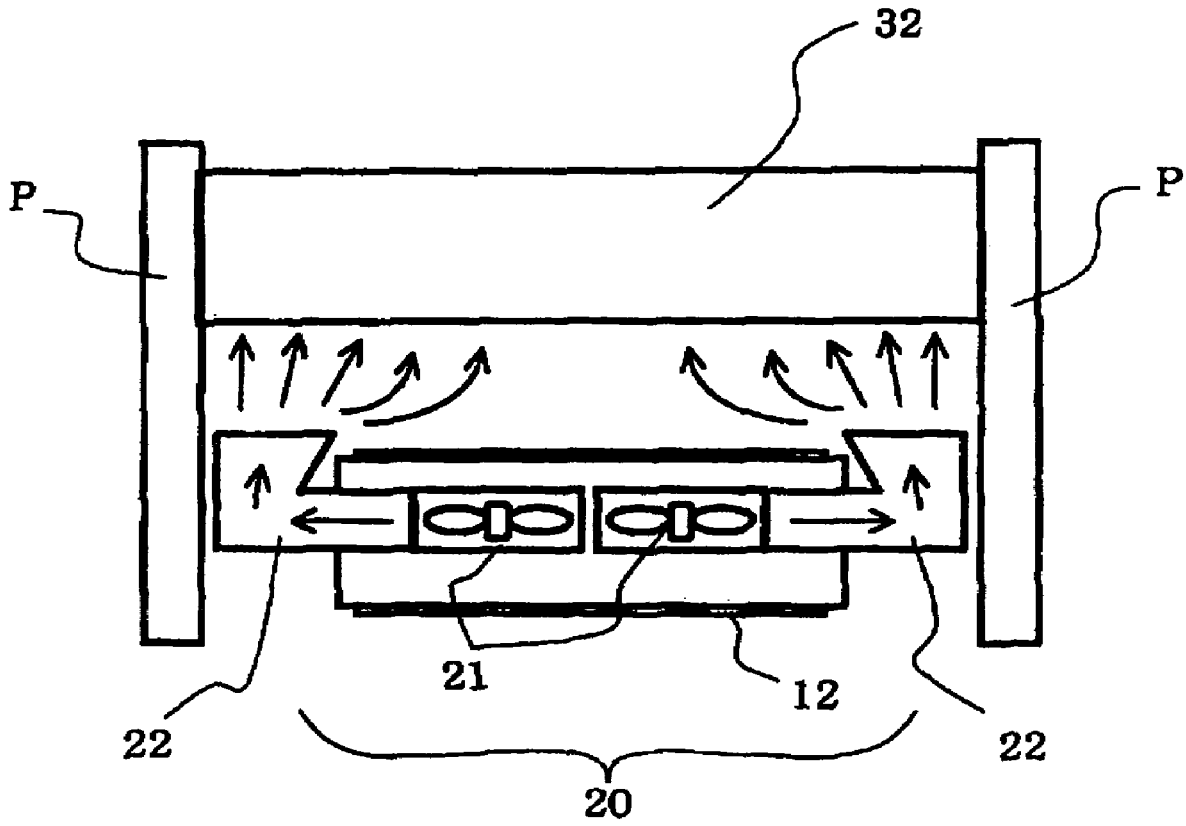
FIG. 6 is a sectional view showing the exhaust duct portion according to the present embodiment.

FIG. 6 shows a view seen from the direction in which a recording material is carried. As shown in FIG. 6, the conveying mechanism 20 extends through the rectangular columns of both the image device frame body 40 and fixing device frame body 30. This means both the frame bodies have openings. Accordingly, this provides a structure in which the exhaust port of the fan duct portion 22 extending from the conveying mechanism 20 is not directly connected to the air suction port of the exhaust duct portion shared with the image forming device frame body 40 and fixing device frame body 30. Further, the opening of the exhaust duct portion is defined over the entire area so as to be perpendicular to the direction in which a sheet is carried. This causes an air flow to surround the conveying mechanism 20 and creates an air curtain in the opening defined in the image forming device frame body 40 and the fixing device frame body 30. This air curtain can prevent heat from being conducted from the opening. The volume of the suction fan 21 (an amount of air exhausted from the exhaust side) must be less than the volume of the exhaust fans 31 disposed in the upper part of the fixing device frame body 30 (an amount of air sucked). If the strength of the air current created by the suction fans 21 of the conveying mechanism 20 is greater than the amount of the air current created by the exhaust fans 31 of the fixing device frame body 30, the air flow is disturbed in an upper part of the conveying mechanism 20 with the result that a toner image transferred to a sheet may be disturbed or an air flow whose temperature has increased enters the image forming device frame body 40 side with the result that the temperature of the image forming device increases.

In this case, as shown in FIGS. 4 to 6, in view of an air flow in the image forming device frame body 40 and fixing device frame body 30, the conveying mechanism 20 is disposed at a distance from the fixing device 13 so that air within the image forming device frame body 40, the temperature of which is low, is drawn by an air flow created by the suction fan 21 provided in the conveying mechanism 20. Various motors mounted in the image forming device frame body 40 are also heat sources. To cope with a temperature rise of the image forming device frame body 40 caused by such heat sources, a duct is disposed in a direction from front to rear of each image forming station, and axial fans are disposed on the suction port side and exhaust port side of the duct. Air outside the main body of the apparatus is sucked from the suction port whereas the air flow is exhausted out of the main body of the apparatus from the exhaust port. Accordingly, the inside temperature of the image forming device frame body 40 is suitably low compared to that of the fixing device frame body 30.

Air in the image forming device frame body 40 is drawn by the suction fans 21 of the conveying mechanism 20 and conveyed outside the sheet conveying region through the fan ducts 22, and exhausted from the upper part of the exhaust duct portion defined between the image forming device frame body 40 and fixing device frame body 30. At this time, the air sucked from the inside of the image forming device frame body 40 as cooling air is blown against the fixing device 13 and the side plates and rectangular column pipes P of the fixing device frame body 30, thereby cooling them. At the same time, the air is conveyed to the upper part of the fixing device frame body 30 and exhausted from the main body of the apparatus.

Since this air flow is disposed between the fixing unit and the image forming device frame body, conveyance of heat generated by the fixing unit to the image forming device frame body is further reduced.

Such a duct structure effectively prevents a rise in temperature of the image forming device in the image forming device frame body 30 without being affected by heat generated by the fixing device 13 and so on. Additionally, the duct structure realizes an image forming apparatus that ensures stable image output free from image deterioration. The number of fixing means accommodated in the fixing device frame body 30 may be only one. In this case, the one fixing device 13 does not need to be disposed in the image forming device frame body 30, either. But by disposing the one fixing device 13 in the fixing device frame body 30, the image forming device in the image forming device frame body 40 is prevented from being affected by heat generated by the fixing device 13. If the number of fixing devices 13 is increased in order to output an image of higher image quality at a higher speed, heat generated by them may have a greater effect on the image forming device. Accordingly it is very effective to accommodate all the fixing devices within the fixing device frame body 30. Additionally, in a configuration where two or more fixing units are disposed, for example, one fixing unit may be disposed in an image forming frame body and the other in a fixing frame body. Even in such a configuration, heat conduction from the image heating frame body to an image forming frame body is prevented by the present invention. Further, in the present embodiment, the recording material conveying means is disposed in the frame body of the image forming apparatus. However, the recording material conveying means may be disposed in the image heating frame body side.

Accordingly, the present embodiment includes the following features. (1) Radiated heat generated from the fixing devices 13 can be efficiently exhausted from the main body of the apparatus. This reduces a rise in the temperature of the image forming device and prevents toner from melting on the surface of the photosensitive drum. (2) Reducing a rise in the temperature of the image forming device ensures fluidity of the toner in the developing portions and cleaning portions, thus preventing toner from melting and fixing. (3) An exhaust air current path passage for the suction fans disposed in the conveying mechanism 20 used to convey a recording sheet (i.e., in this case, a transfer material sheet) is clearly defined to prevent an air flow from scattering within the main body of the apparatus. This prevents the inside temperature of the main body of the apparatus from rising, which can prevent image deterioration due to melting the toner one the surface of the photosensitive drum.

While the embodiment according to the invention has been described, it is to be understood that the invention is not limited to the above-described embodiment. On the contrary, the invention is intended to cover various modifications within the spirit and scope of the invention.

This application claims the benefit of priority from the prior Japanese Patent Application No. 2005-175707 filed on Jun. 15, 2005 the entire contents of which are incorporated by reference herein.

What is claimed is:

1. An image forming apparatus comprising:

an image forming unit for forming a toner image on a recording material;

a first accommodating body for accommodating the image forming unit;

a fixing unit for fixing an image formed by the image forming unit on the recording material;

a second accommodating body for accommodating the fixing unit, wherein the second accommodating body is independently movable with respect to the first accommodating body;

a recording material discharge opening on the first accommodating body for discharging the recording material, wherein the recording material discharge opening is disposed on a first side face of the first accommodating body;

a recording material reception opening on the second accommodating body for receiving the recording material from the recording material discharging opening, wherein the recording material reception opening is disposed on a second side face on the second accommodating body;

a connecting portion projecting from at least one of the first side face and the second side face so as to contact and form a space between the first side face and the second side face; and a fan to produce an airflow from the space to outside of the image forming apparatus, wherein the connecting portion is disposed on the first side face and the connecting portion is a pipe attached in a vertical direction with respect to the first accommodating body.

2. An image forming apparatus comprising:

an image forming unit for forming a toner image on a recording material;

a first accommodating body for accommodating the image forming unit;

a fixing unit for fixing an image formed by the image forming unit on the recording material;

a second accommodating body for accommodating the fixing unit, wherein the second accommodating body is independently movable with respect to the first accommodating body;

a recording material discharge opening on the first accommodating body for discharging the recording material, wherein the recording material discharge opening is disposed on a first side face of the first accommodating body;

a recording material reception opening on the second accommodating body for receiving the recording material from the recording material discharging opening, wherein the recording material reception opening is disposed on a second side face on the second accommodating body;

a connecting portion projecting from at least one of the first side face and the second side face so as to contact and form a space between the first side face and the second side face; and a fan to produce an airflow from the space to outside of the image forming apparatus, wherein the connecting portion is disposed on the second side face and the connecting portion is a pipe attached in a vertical direction with respect to the second accommodating body.

3. An image forming apparatus comprising:

an image forming unit for forming a toner image on a recording material;

a first accommodating body for accommodating the image forming unit;

a fixing unit for fixing an image formed by the image forming unit on the recording material;

a second accommodating body for accommodating the fixing unit, wherein the second accommodating body is independently movable with respect to the first accommodating body;

a recording material discharge opening on the first accommodating body for discharging the recording material, wherein the recording material discharge opening is disposed on a first side face of the first accommodating body;

a recording material reception opening on the second accommodating body for receiving the recording material from the recording material discharging opening, wherein the recording material reception opening is disposed on a second side face on the second accommodating body;

a connecting portion projecting from at least one of the first side face and the second side face so as to contact and form a space between the first side face and the second side face; and a fan to produce an airflow from the space to outside of the image forming apparatus, wherein the connecting portion is disposed on both the first side face and the second side face, and the connecting portion is a pipe attached in a vertical direction with respect to both the first accommodating body and the second accommodating body.

4. The image forming apparatus according to claim 1, 2 or 3, wherein the second accommodating body includes a duct for guiding air in the space to outside of the image forming apparatus.

5. The image forming apparatus according to claim 4, wherein the fan is disposed inside the duct.

6. The image forming apparatus according to claim 4, wherein the duct is disposed at a position higher than a position of the fixing unit in a vertical direction of the second accommodating body.

* * * * *